US008824950B2

(12) United States Patent
Nakamura et al.

(10) Patent No.: US 8,824,950 B2
(45) Date of Patent: Sep. 2, 2014

(54) IMAGE FORMING APPARATUS

(75) Inventors: Masakazu Nakamura, Hino (JP); Takahiro Iwasaki, Toyokawa (JP); Masami Maruko, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 318 days.

(21) Appl. No.: 13/447,454

(22) Filed: Apr. 16, 2012

(65) Prior Publication Data

US 2012/0266811 A1 Oct. 25, 2012

(30) Foreign Application Priority Data

Apr. 21, 2011 (JP) ..... 2011-094730

(51) Int. Cl.
*G03G 21/00* (2006.01)

(52) U.S. Cl.
CPC ..... *G03G 21/0035* (2013.01); *G03G 21/0094* (2013.01); *G03G 21/0005* (2013.01)
USPC ..... 399/346; 399/347; 399/353; 430/119.85; 118/258

(58) Field of Classification Search
CPC ..... G03G 21/0094
USPC ..... 399/346, 347; 430/119.85
See application file for complete search history.

(56) References Cited

U.S. PATENT DOCUMENTS

| | | | | |
|---|---|---|---|---|
| 5,620,788 | A * | 4/1997 | Garavaglia et al. | 442/118 |
| 6,655,860 | B2 * | 12/2003 | Nozawa et al. | 396/614 |
| 7,076,199 | B2 * | 7/2006 | Nishida | 399/346 |
| 7,496,324 | B2 * | 2/2009 | Sugiura et al. | 399/346 |
| 7,929,875 | B2 * | 4/2011 | Nishida | 399/48 |
| 8,180,271 | B2 * | 5/2012 | Hatakeyama et al. | 399/346 |
| 8,380,115 | B2 * | 2/2013 | Shintani et al. | 399/346 |
| 8,676,107 | B2 * | 3/2014 | Okamoto et al. | 399/346 |
| 2013/0017006 | A1 * | 1/2013 | Suda | 399/346 |
| 2013/0336693 | A1 * | 12/2013 | Nakamura | 399/346 |

FOREIGN PATENT DOCUMENTS

| | | |
|---|---|---|
| JP | 2007-225847 A | 9/2007 |
| JP | 2010-169937 A | 8/2010 |
| JP | 2010-210799 A | 9/2010 |

* cited by examiner

*Primary Examiner* — David Gray
*Assistant Examiner* — Geoffrey Evans
(74) *Attorney, Agent, or Firm* — Cantor Colburn LLP

(57) ABSTRACT

The rotating speed of the coating brush of the image forming apparatus fluctuates between the upper limit speed and the lower limit speed across the standard speed. Consequently, the positional relation of the contact between the brush textile of the coating brush and the surface of the photographic sensitive drum varies for a wider range compared to a case where the rotating speed of the coating brush does not vary. Since the thin area of the brush textile moves for a wider range of the surface of the photographic sensitive drum in the axial direction of the rotating shaft of the photographic sensitive drum, the area where the coating amount of the lubricant is less is evened out by the area where the coating amount of the lubricant is rich, thus improving the unevenness of coating of the lubricant on the photographic sensitive drum.

3 Claims, 8 Drawing Sheets

IMAGE FORMING APPARATUS

CROSS-REFERENCE TO RELATED APPLICATION

This application is based on Japanese Patent Application No. 2011-094730 filed on Apr. 21, 2011, the contents of which are incorporated herein by reference.

BACKGROUND

1. Technical Field

The present invention relates to an image forming apparatus such as an electro-photographic copying machine or printer, in particular to an image forming apparatus equipped with a coating brush for coating a rotating member with a lubricant.

2. Description of Related Art

The image forming apparatus such as an electron-photographic copying machine or printer uses various rotating members such as an image carrying member typical of which is a photographic sensitive drum, a transfer roller used in the secondary transfer position, or a belt or roller used in the fixing unit. It is performed widely to coat these rotating members with lubricants for various purposes, such as for improving the toner image transfer performance, the toner image fixing performance, the residual toner cleaning performance, and the abrasion resistance performance of the rotating member.

Solid salts of fatty acids such as zinc stearate are often used as the lubricant. As a member for coating the rotating member with the lubricant, a coating brush TB comprising a brush textile 464, which is a belt-like base material implanted with brush fabrics wrapped around a metal core 463, such as shown in FIG. 1, is used. In coating the rotating member with the lubricant, the coating brush TB provided to contact both the rotating member and the lubricant is rotated so that the rotating member is coated with a certain amount of the lubricant scraped up from the solid lubricant.

It is known that, in coating the rotating member with the lubricant from the coating brush TB, the coating amount of the lubricant can be controlled by the rotation of the coating brush TB. More specifically, the rotating speed of the coating brush TB is controlled according to a predetermined standard, examples of which can be seen in three documents, i.e., Patent Document 1 (Unexamined Japanese Patent Publication No. 2010-210799), Patent Document 2 (Unexamined Japanese Patent Publication No. 2010-169937), and Patent Document 3 (Unexamined Japanese Patent Publication No. 2007-225847). Patent Document 1 discloses controlling the coating weight by detecting the torque of the coating brush and changing the rotating speed of the coating brush corresponding to the obtained torque value in order to coat the photographic sensitive drum with the lubricant in a stable manner continuously. Patent Document 2 discloses controlling the rotating speed of the coating brush TB corresponding to the image area ratio, which is one of the printing conditions. Patent Document 3 discloses controlling the rotating speed of the coating brush TB corresponding to the consumption amount of the lubricant.

It is also known to control the rotating speed of the rotating member. This is because the rotating member has to be positioned in contact with the coating brush TB and the rotating speed of the rotating member may cyclically change due to the jouncing of the driving unit of the coating brush TB and the wobbling of the metal core 463 of the coating brush TB. Consequently, in certain models of image forming apparatus, the variation of the rotating speed of a rotating member within one revolution is detected using an encoder and the detected result is fed back to the subsequent control of the rotating speed of the rotating member.

In case of such an image forming apparatus, it is necessary to choose the ratio between the rotating speed of the rotating member and the rotating speed of the coating brush TB to be a multiple of a natural number in order to feed back the variation of the rotating speed of a rotating member within one revolution to the subsequent control of the rotating speed of the rotating member. For example, in order to arrange the rotating speed of a rotating member be 95.4 rpm and the rotating speed of a coating brush TB be 381.6 rpm, the ratio between the rotating speed of the rotating member and the rotating speed of the coating brush TB is chosen to be 1:4. As a result, it is inevitable that the surface of the rotating member contacts with the coating brush TB always at the same position.

As the brush textile 464 is spirally wrapped around the metal core 463, the density of the brush textile 464 varies along the longitudinal direction of the coating brush TB. Such a variation in the density becomes one of the causes of the unevenness of coating. More specifically, the coating amount of the lubricant to the rotating member is less in an area where the brush textile 464 is thin, while the coating amount of the lubricant to the rotating member is more in an area where the brush textile 464 is dense.

Consequently, if such a coating brush TB is used while maintaining the ratio between the rotating speed of the rotating member and the rotating speed of the coating brush TB at a multiple of a natural number, the unevenness of coating on the rotating member results because the surface of the rotating member contacts with the coating brush TB always at the same position. An example of such unevenness of coating is shown in FIG. 2. FIG. 2 is an expansion plan of the rotating member 41. The area A in the expansion plan is where the coating amount of lubricant decreases because the contact with the thin area of the brush textile 464 is made. The area B is where the coating amount of lubricant increases because the contact with the thick area of the brush textile 464 is made. Thus, the density variation of the brush textile 464 causes the unevenness of coating on the rotating member 41.

Therefore, it is customary to choose the ratio between the rotating speed of the rotating member and the rotating speed of the coating brush TB to stay away from a multiple of a natural number within a range of being able to feed back the variation of the rotating speed of a rotating member within one revolution normally to the subsequent control of the rotating speed of the rotating member. Specifically, it is controlled to make the rotating speed of the coating brush TB either slightly faster or slightly slower than the standard speed, which is a multiple of a natural number of the rotating speed of the rotating member. This makes it possible to avoid the surface of the rotating member from contacting with the coating brush TB always at the same position. However, such a countermeasure is not quite sufficient to suppress the unevenness of coating.

SUMMARY

The present invention is made in order to solve the abovementioned problem associated with the related art, and to provide an image forming apparatus capable of improving the unevenness of coating on the rotating member.

To achieve at least one of the abovementioned objects, an image forming apparatus reflecting one aspect of the present invention comprises: a rotating member supported rotatably;

a rotatable coating brush that is wound spirally on a metal core in order to coat the rotating member with a lubricant; a supply unit for supplying the lubricant on the coating brush; a drive unit for driving the coating brush; and a controller for controlling the driving unit in such a way as to cause a rotating speed of the coating brush to fluctuates between a upper limit speed and a lower limit speed across a standard speed obtained by multiplying a rotating speed of the rotating member with a predetermined natural number. The controller controls the driving unit in such a way as to cause a fluctuation cycle of the rotating speed of the coating brush and a cycle of the rotating member to be different in case when a mean rotating speed within one cycle of the coating brush matches with the standard speed while the rotating speed of the coating brush fluctuates.

It is preferable in the above image forming apparatus that the rotating speed of the coating brush is at least either the upper limit speed or the lower limit speed while the rotating speed of the coating brush is fluctuating.

It is preferable in the above image forming apparatus that the rotating speed of the coating brush is held at a predetermined speed for a predetermined time period while the rotating speed of the coating brush is fluctuating.

The objects, features, and characteristics of this invention other than those set forth above will become apparent from the description given herein below with reference to preferred embodiments illustrated in the accompanying drawings.

DETAILED DESCRIPTION

The embodiments of the present invention will be described in detail below with reference to the accompanying drawings. Although the embodiment of the present invention describe below accompany various limitations which are considered preferable in applying the present invention, they are not to be construed to limit the claims of the invention in any way to the embodiment and the drawings described below. Also, the scaling ratios of the drawings may vary from those of the actual components because of intentional exaggerations for the sake of explanations.

Figure 3:
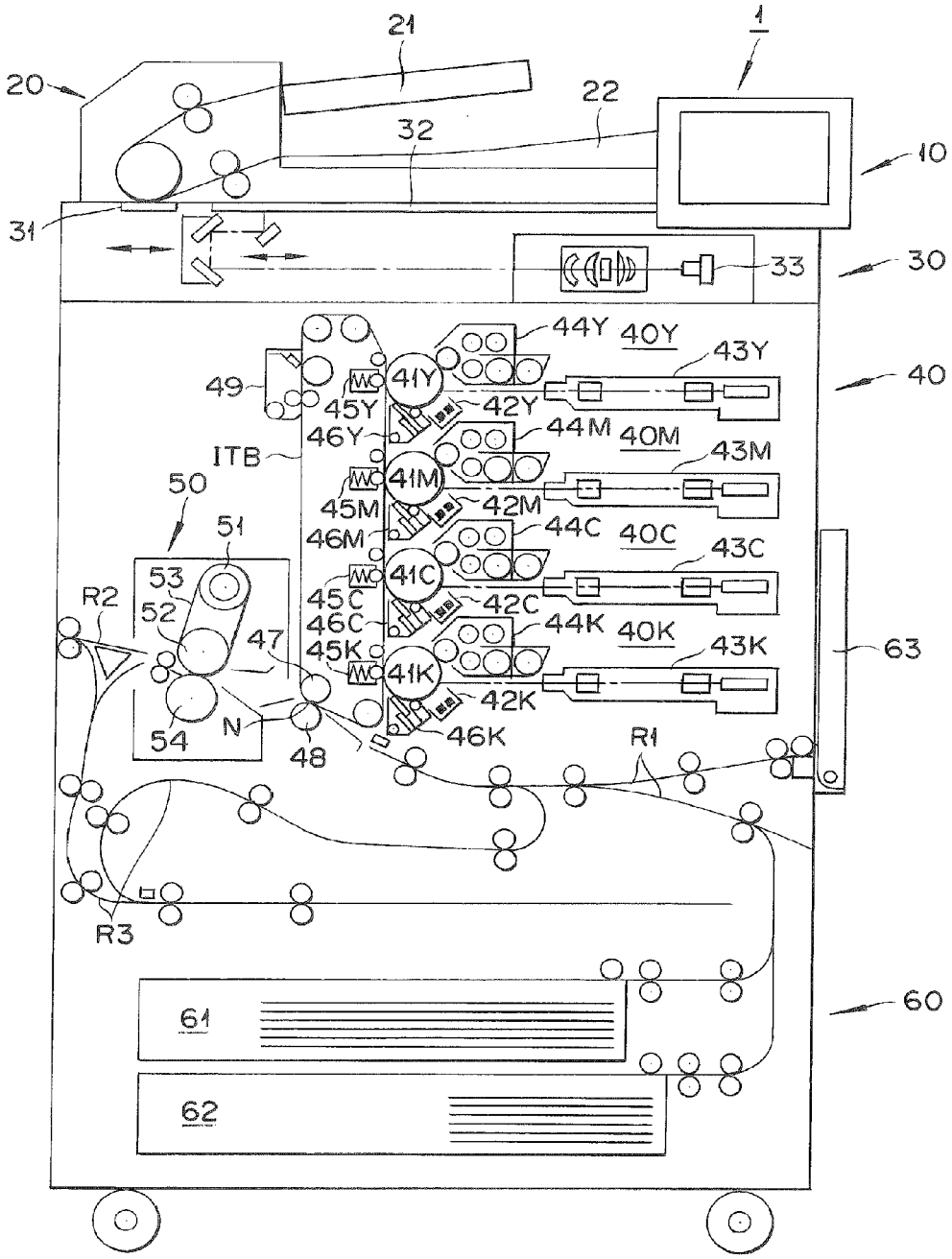
FIG. 3 is a schematic view showing an image forming apparatus according to an embodiment of the present invention.

FIG. 3 is a schematic view showing an image forming apparatus 1 according to an embodiment of the present invention.

The image forming apparatus 1 is equipped with an operating unit 10, an automatic document feeding unit 20, a scanning unit 30, an image forming part 40, a fixing unit 50, and a paper supply unit 60.

The operating unit 10 is equipped with a touch screen formed integrally with the display surface, e.g., LCD (liquid crystal display), a ten key, a start button, and a stop button. The user can prepare various settings concerning the printing such as document setup, picture quality setup, scaling setup, application setup, output setup, single side/duplex printing setup, paper setup, and page replacement by means of using the operating unit 10. The operating unit 10 is also equipped with functions of settings related to facsimile, scan, box, etc.

The automatic document feeding unit 20, which is also called ADF (Automatic Document Feeder), is a device equipped with a paper supply tray 21 and a paper discharge tray 22 for feeding a document automatically for scanning it. As the start button on the operating unit 10 is pressed, a document placed on the paper supply tray 21 is transported to the position of a document scanning slit glass 31 of the scanning unit 30 where the document is scanned to produce its image data. After that, the document is discharged to the paper discharge tray 22.

The scanning unit 30 is equipped with the document scanning slit glass 31, a platen glass 32, a CCD (Charge Coupled Device) 33, a plurality of lenses, and a light source, and acquires the image of the document transported from the paper supply tray 21 to the document scanning slit glass 31 or placed on the platen glass 32.

More specifically, if the automatic document feeding unit 20 is used, the document is transported, one sheet at a time, from a bundle of document sheets placed on the paper supply tray 21 to the document scanning slit glass 31 of the scanning unit 30. As the document is irradiated by the light from the light source, the image data of the document is acquired as the CCD 33 receives the light reflected from the document. When the document placed on the platen glass 32 is irradiated by the light from the light source, the image data of the document is acquired as the CCD 33 receives the reflected light reflected from the document. The image data thus obtained is stored as the print data in a RAM 103 or a hard disk 104.

The image forming part 40 comprises a first image forming unit 40Y that forms an yellow color image, a second image forming unit 40M that forms a magenta color image, a third image forming unit 40C that forms a cyan color image, and a forth image forming unit 40K that forms a black color image. The image forming part 40 is further equipped with an intermediate transfer belt ITB, a first nip roller 47, a second nip roller 48, and a cleaning device 49. The intermediate transfer belt ITB is a holding device that holds the image formed by the first image forming unit 40Y through the fourth image forming unit 40K. The first nip roller 47 and the second nip roller 48 transfer the image existing on the intermediate transfer belt ITB to the paper as the recording medium. The cleaning device 49 collects the toner remaining on the intermediate transfer belt ITB after the transfer.

The fixing unit 50 is equipped with a heating roller 51, the fixing roller 52, a fixing belt 53 tensioned by the heating roller 51 and the fixing roller 52, and a pressuring roller 54 positioned to face the fixing roller 52 across the fixing belt 53.

The following paragraph describes the electrophotographic method applied by the image forming part 40 and the fixing unit 50 to form the image on the paper. In this description, the first image forming unit 40Y is used as a typical unit for the description as all the first image forming unit 40Y through the fourth image forming unit 40K perform a similar function.

The first image forming unit 40Y is equipped with a photographic sensitive drum 41Y, a charging part 42Y, an exposing part 43Y, a developing part 44Y, a transfer part 45Y, and a cleaning-coating device 46Y. In forming a yellow color image, the photographic sensitive drum 41Y charged by the charging part 42Y is exposed and scanned by a laser beam radiated from the exposing part 43Y based on the printing data. This causes the photographic sensitive drum 41Y to form an electrostatic latent image. Next, the photographic sensitive drum 41Y adsorbs the yellow color toner at the developing part 44, and transfers the image to the intermediate transfer belt ITB (so-called "primary transfer") at the transferring part 45Y.

After that, the yellow color image on the intermediate transfer belt ITB is overlaid with images of individual colors formed by the second image forming unit 40M, the third image forming unit 40C, and the fourth image forming unit 40K, respectively. The images thus overlaid are transported to a nipping part N under a condition of being held by the intermediate transfer belt ITB, and then transferred to the paper transported from the paper supply unit 60 (so-called "secondary transfer"). The fixing unit 50 fixes the image of the paper as it applies heat and pressure to the paper.

The paper supply unit 60 is equipped with a plurality of paper trays 61 through 63 in order to store various kinds of paper as a storage. A paper tray 63 is for manual feeding. The sheets of paper stored in the paper trays 61 through 63 are transported to the specified position by multiple pairs of rollers. More specifically, a sheet of paper supplied from either one of the trays is transported to the nipping part N via the transport route R1. The sheet of paper sent out from the fixing unit 50 is discharged outside of the image forming apparatus 1 via the discharge transport route R2, or transported back to the nipping part N after cycling through the image forming apparatus 1 via the retransport route R3. Although it is assumed that three paper trays are used in the present embodiment, the invention is not limited to such an assumption. It is possible to have a single or a plurality of paper feeding devices to store a large quantity of paper as needed.

Let us now describe the coating brush TB that coats, with the lubricant, the surface of each of the photographic sensitive drums 41Y, 41M, 41C and 41K using the photographic sensitive drums 41Y as an example.

Figure 4:
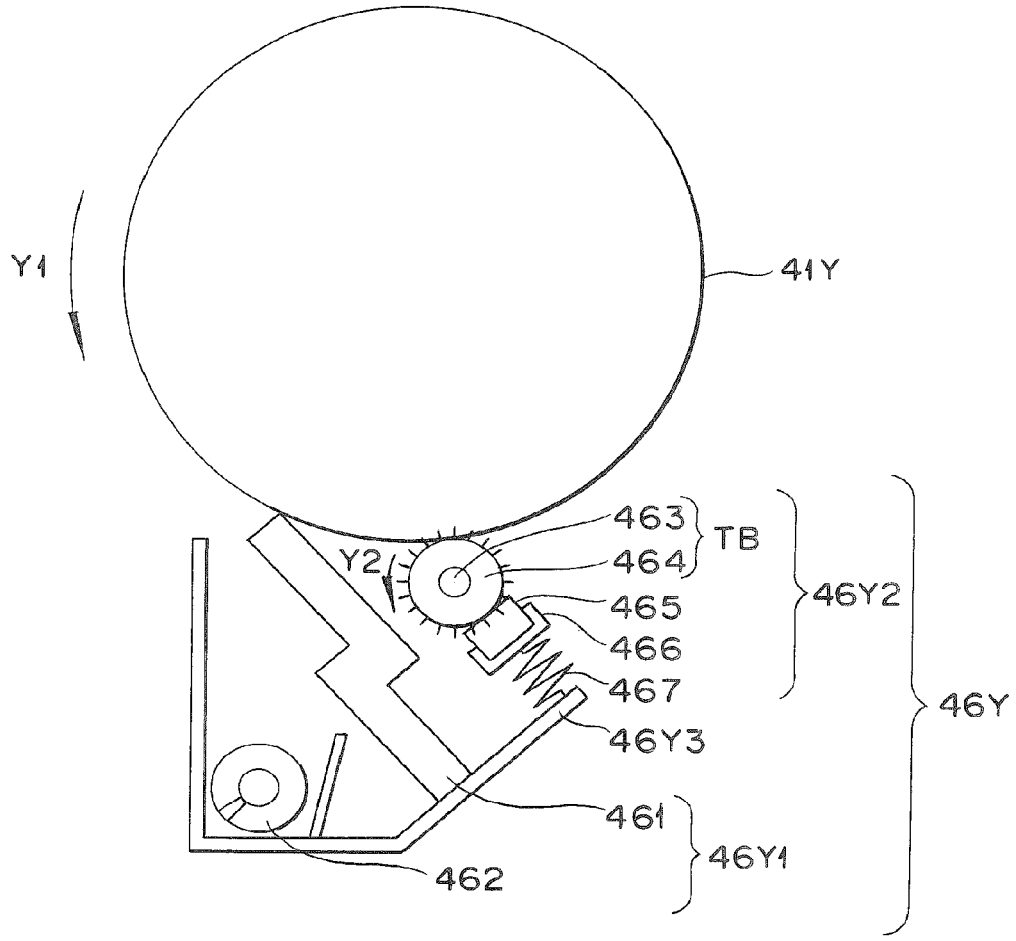
FIG. 4 is an enlarged view of the vicinity of the cleaning-coating device.

FIG. 4 is an enlarged view of the vicinity of the cleaning-coating device 46Y.

The cleaning-coating device 46Y is equipped with a cleaning part 46Y1, a coating part 46Y2, and an external wall 46Y3.

The cleaning part 46Y1 is equipped with a cleaning blade 461 and a transport screw 462. There are held in the external wall 46Y3. The cleaning blade 461 is provided to collect the toner remained on the surface of the photographic sensitive drum 41Y that rotates in a rotating direction Y1, which appears as a counterclockwise rotation in FIG. 4. The transport screw 462 is provided for transporting the toner collected by the cleaning blade 461 to the specified location.

Figure 1:
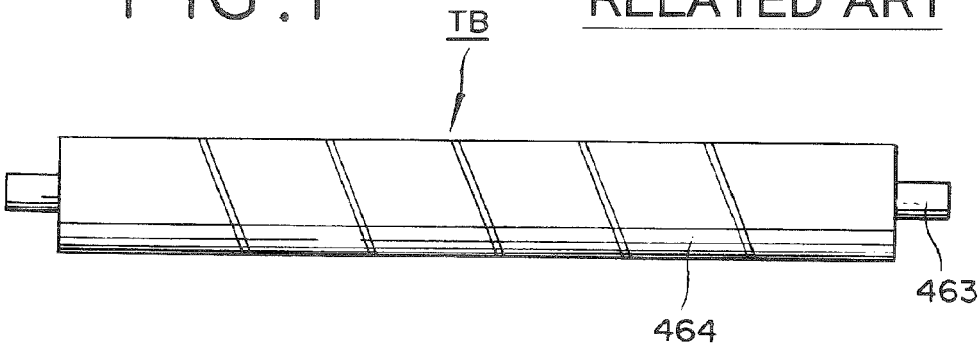
FIG. 1 RELATED ART
FIG. 1 is a schematic view of a coating brush concerning the related art.

The coating part 46Y2 is equipped with a coating brush TB, a lubricant 465, a supporting block 466, and a compression spring 467. The coating brush TB has configuration similar to the one shown in FIG. 1, and is equipped with a metal core 463 and a brush textile 464. More specifically, the coating brush TB is formed by spirally wrapping the brush textile 464, which is consisting of brush hairs planted for the belt width along the lengthwise direction, around the cylindrically shaped metal core 463 without overlapping. A typical example of the brush textile 464 is a base fabric of tufted carpet where piles are inserted. The raw materials of such a base fabric include jute, polypropylene, cotton and vinylon (polyvinyl alcohol synthetic fiber), and such a base cloth is made by plain weaving or as an unwoven fabric. The coating brush TB coats the photographic sensitive drum 41Y with the lubricant 465 as it is rotated in a direction Y2, which is the same direction as the rotating direction Y1 of the photographic sensitive drum 41Y, by a driving unit 70 to be described later.

The lubricant 465 consists of metal salts of fatty acid, such as lead oleate, zinc oleate, copper oleate, zinc stearate, cobalt stearate, ferric stearate, copper stearate, zinc palmitate, copper palmitate, and zinc linolenate. Of these, solid zinc stearate is most preferable.

The support block 466 is a concave block, whose concave part supports the lubricant 465. The support block 466 is urged by the compression spring 467 mounted on the external wall 46Y3 to press the lubricant 465 against the coating brush TB. The support block 466 and the compression spring 467 function as the supply unit in the present embodiment.

Moreover, although the cleaning part 46Y1 and the coating part 46Y2 constitute integrally the cleaning-coating device 46Y via the external wall 46Y3 in the present embodiment, they do not necessarily have to constitute it integrally.

Figure 5:
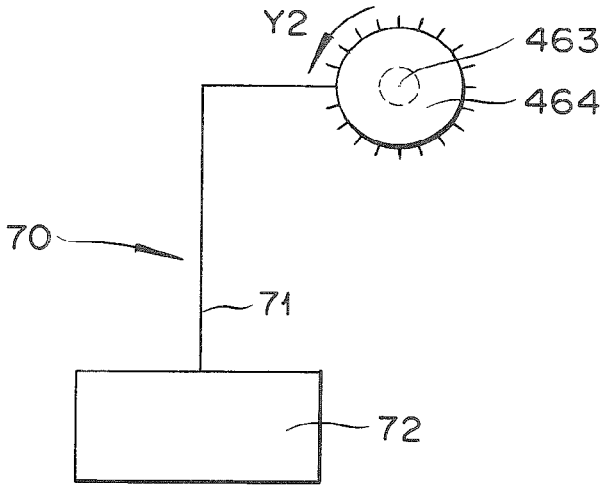
FIG. 5 is an explanation drawing of the driving unit for driving the coating brush.

Next, let us describe the driving unit 70 for driving the coating brush TB with reference to FIG. 5.

As shown in FIG. 5, the driving unit 70 is equipped with a drive mechanism 71 and a drive motor 72. The drive mechanism 71, for example, has a plurality of gears. More specifically, the drive mechanism 71 is equipped with a first gear mounted on the shaft of the coating brush TB and a second gear mounted on the shaft of the drive motor 72, where the first and second gears are in mesh with each other. This causes the coating brush TB to rotate linked with the rotation of the shaft of the drive motor 72.

Figure 6:
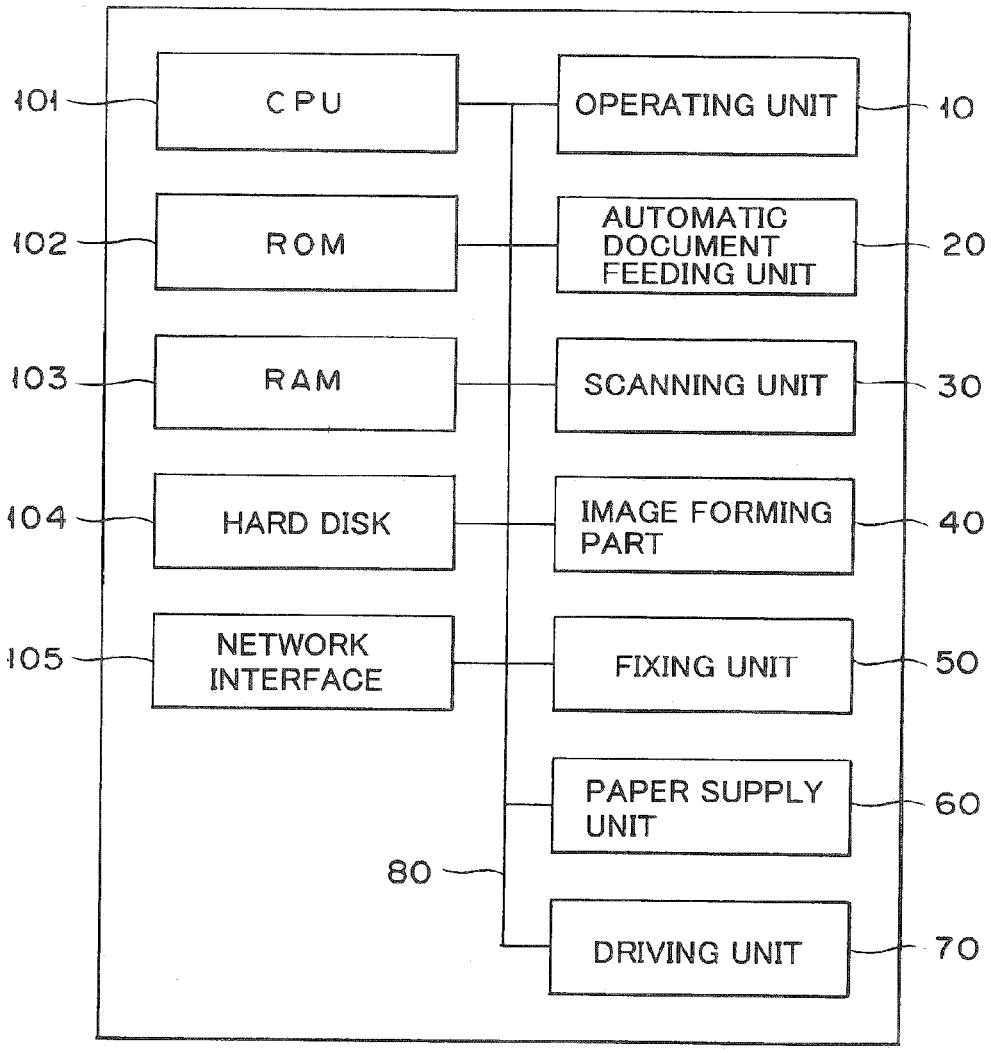
FIG. 6 is a block diagram showing the electrical configuration of the image forming apparatus.

Next, let us describe with reference to FIG. 6 the electrical configuration of the image forming apparatus 1 according to the present embodiment of the present invention.

The image forming apparatus 1 is equipped with a CPU (Central Processing Unit) 101, a ROM (Read Only Memory) 102, a RAM (Random Access Memory) 103, a hard disk 104, a network interface 105, the operating unit 10, the automatic document feeding unit 20, the scanning unit 30, the image forming unit 40, the fixing unit 50, the paper supply unit 60 and the driving unit 70. These are connected with each other via a bus 80.

The CPU 101 has a function as a controller to control those other parts integrally. The ROM 102 stores various programs and various kinds of data. The RAM 103 temporarily stores programs and data as a work area. The hard disk 104 stores various programs including the operating system and various kinds of data. More specifically, the CPU 101 expands, in the RAM 103, programs specified among various programs stored in the ROM 102 or the hard disk 104, and executes various processes in coordination with the programs expanded in the RAM 103. For example, the CPU 101 executes the coating brush fluctuation program (to be described later) for rotating the coating brush TB by driving the driving unit 70.

The network interface 105 is equipped with various kinds of interface such as NIC (Network Interface Card), MODEM (MOdulator-DEModulator), USB (Universal Serial Bus) etc., in order to connect with external devices. For example, the network interface 105 is connected with a personal computer, which is an external device, to receive print data from aforesaid personal computer. The print data is configured in a page description language (PDL), and is converted into rasterized print data of the bitmap format after receiving. There can be a plurality of external devices to be connected, and the external device can be a different MFP (Multi-Function Peripheral) having copying, printing, and scanning functions, printer, or print server in addition to a personal computer.

In the following, an example of fluctuation of the rotating speed of the coating brush TB will be described with reference to FIGS. 7 through 9.

In the present embodiment, the CPU 101 controls the driving unit 70 based on the coating brush fluctuation program stored in the storage device such as the ROM 102 or the hard disk 104 in order to cause fluctuation to the rotating speed of the coating brush TB. In FIGS. 7 through 9, the dash line indicates the standard speed obtained by multiplying the rotating speed of the photographic sensitive drum 41Y with a predetermined natural number, while the solid line indicates the rotating speed of the coating brush TB relative to the rotation angle of the photographic sensitive drum 41Y. Let us assume here that the rotating speed of the photographic sensitive drum 41Y be 95.4 rpm and the predetermined natural number be 4. Consequently, the standard speed is in 381.6 rpm.

Figure 2:
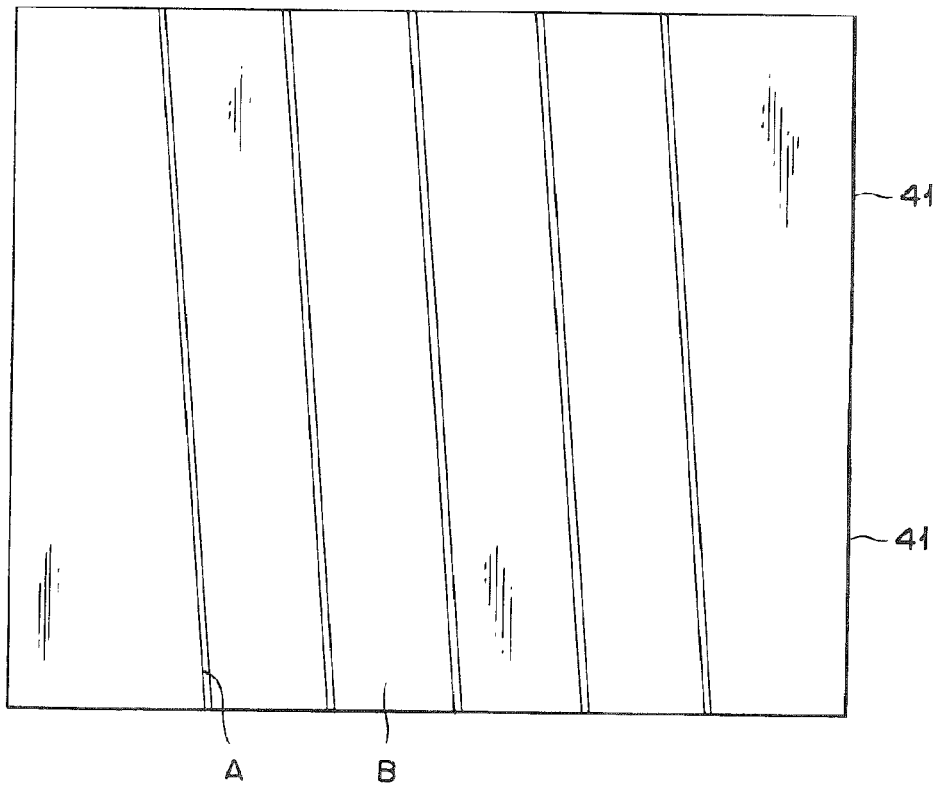
FIG. 2 RELATED ART
FIG. 2 is an expansion plan of a rotating member in order to show an example of the unevenness of coating concerning the related art.

In the present embodiment, the rotating speed of the coating brush TB fluctuates between the upper limit speed and the lower limit speed to be described later across the standard speed. As a result, the positional relation of the contact between the brush textile 464 of the coating brush TB and the surface of the photographic sensitive drum 41Y varies within a wider range compared to a case when the rotating speed of the coating brush TB fluctuates between the upper limit speed and the lower limit speed without crossing the standard speed, or a case when the rotating speed of the coating brush TB is slightly faster or slighter slower than the standard speed. In other words, the thin area of the brush textile 464 of the coating brush TB moves for a wider range of the surface of the photographic sensitive drum 41Y in the axial direction of the rotating shaft of the photographic sensitive drum 41Y. As a result, the area A where the coating amount of the lubricant is less as shown in FIG. 2 is evened out by the area B where the coating amount of the lubricant is rich, thus improving the unevenness of coating of the lubricant on the photographic sensitive drum 41Y.

In the present embodiment, the upper limit of the rotating speed of the coating brush TB is +0.25% of the standard speed (i.e., 382.5 rpm) and the lower limit is −0.25% of the standard speed (i.e., 380.7 rpm). These upper and lower limits of the speed were empirically obtained, while they can vary with the specification of the apparatus. The upper and lower limits of the speed need to be obtained within the range that the fluctuation of the rotating speed within one revolution of the photographic sensitive drum 41Y can be properly fed back to the control of the rotating speed of the next photographic sensitive drum 41Y.

Figure 7:
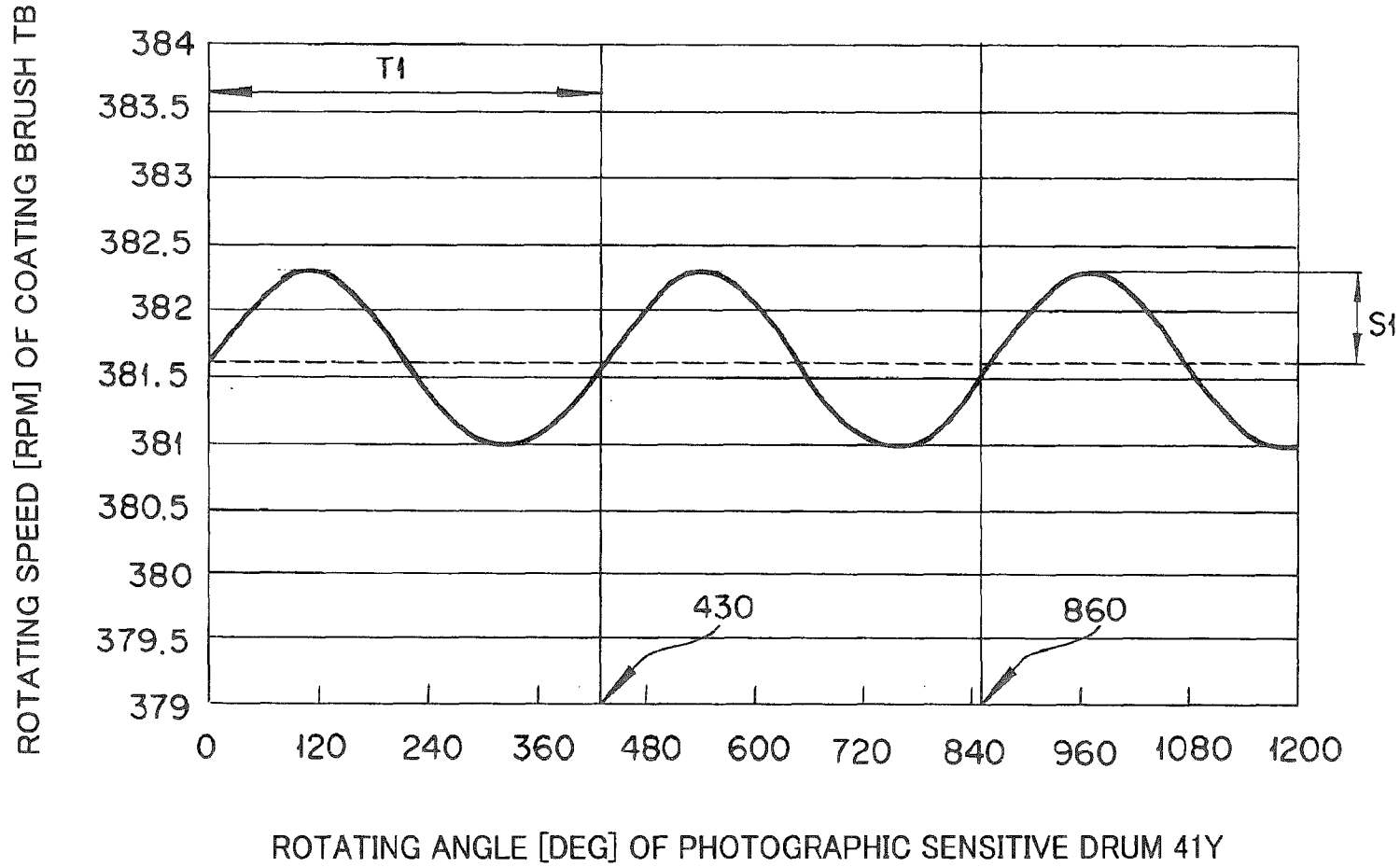
FIG. 7 is a diagram showing a first example related to the fluctuation of the rotating speed of the coating brush relative to the rotating angle of the photographic sensitive drum.

FIG. 7 is a diagram showing a first example related to the fluctuation of the rotating speed of the coating brush TB relative to the rotating angle of the photographic sensitive drum 41Y. The rotating speed of the coating brush TB varies in a cyclical waveform consisting of a sinusoidal wave with an amplitude S1 and a fluctuation cycle T1. Consequently, the standard speed is a mean rotating speed, which is a mean value of the rotating speed of one cycle of the coating brush TB (fluctuation cycle T1) when the rotating speed of the coating brush TB varies.

Since the amplitude S1 is 0.6 rpm in the first example, the maximum rotating speed of the coating brush TB is 382.2 rpm and the minimum rotating speed is 381.0 rpm. Therefore, the rotating speed of the coating brush TB fluctuates between the upper limit speed and the lower limit speed across the standard speed.

The fluctuation cycle T1 is 430 degrees in terms of the rotating angle of the photographic sensitive drum 41Y. In other words, the cycle of the photographic sensitive drum 41Y is 70 degrees offset from the fluctuation cycle T1. By offsetting the cycle of the photographic sensitive drum 41Y from the fluctuation cycle T1, the unevenness of coating of the lubricant 465 to the photographic sensitive drum 41Y can be improved.

On the other hand, if the fluctuation cycle T1 is 360 degrees in terms of the rotating angle of the photographic sensitive drum 41Y in the first example, the unevenness of coating of the lubricant 465 to the photographic sensitive drum 41Y does not improve even if the rotating speed of the coating brush TB is fluctuated. This is because the positional relation of the contact between the brush textile 464 of the coating brush TB and the surface of the photographic sensitive drum 41Y does not vary for each rotation of the photographic sensitive drum 41Y, because the fluctuation cycle T1 and the cycle of the photographic sensitive drum 41Y is the same. In other words, it is because the photographic sensitive drum 41Y rotates in such a way that the surface of the photographic sensitive drum 41Y contacts with the coating brush TB always at the same position. As a consequence, in case the mean rotating speed during one cycle of the coating brush TB is the standard speed as the rotating speed of the coating brush TB varies in a cyclical waveform, it is necessary to offset the cycle of the photographic sensitive drum 41Y from the fluctuation cycle T1.

Figure 8:
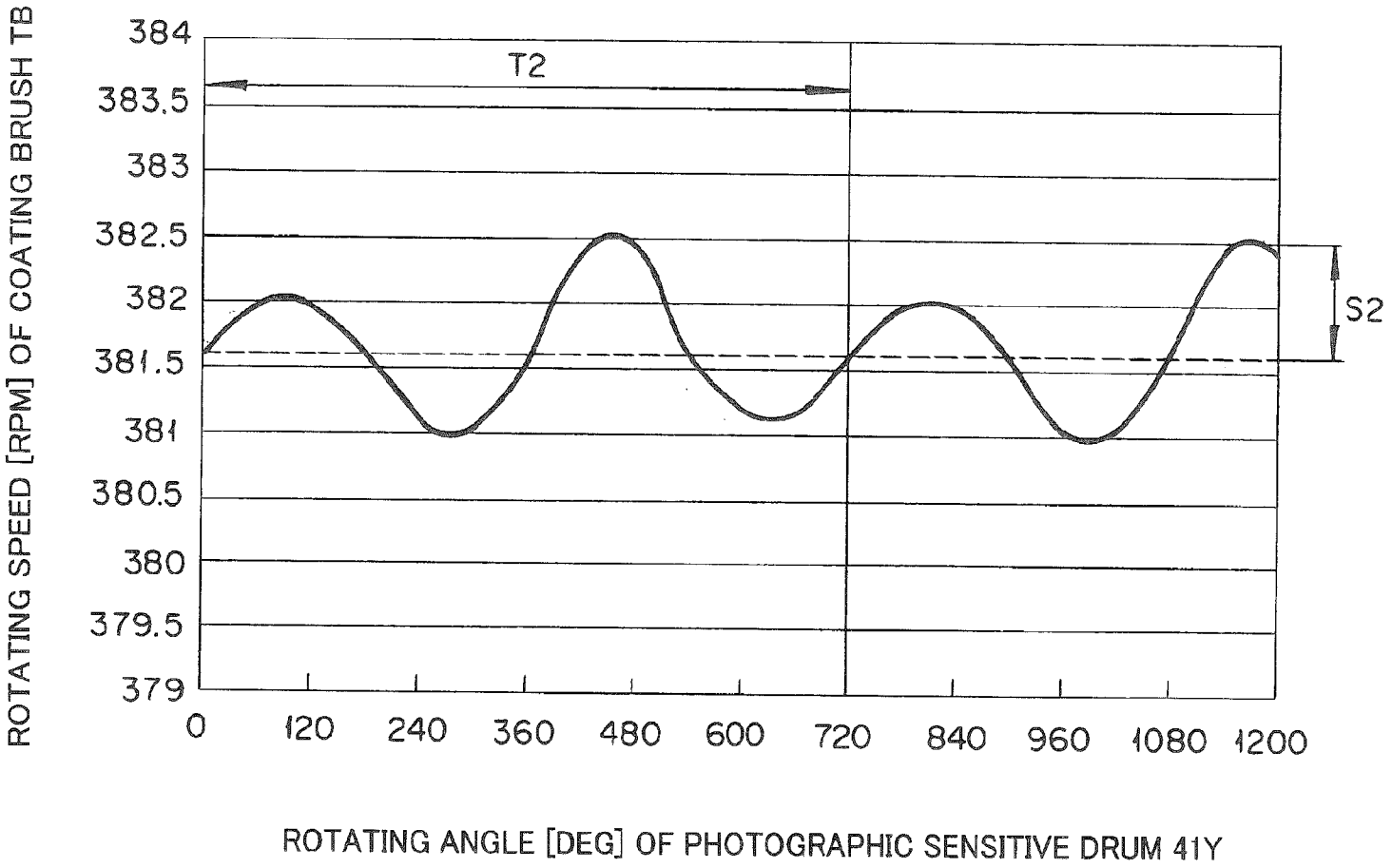
FIG. 8 is a diagram showing a second example related to the fluctuation of the rotating speed of the coating brush relative to the rotating angle of the photographic sensitive drum.

FIG. 8 is a diagram showing a second example related to the fluctuation of the rotating speed of the coating brush TB relative to the rotating angle of the photographic sensitive drum 41Y.

The rotating speed of the coating brush TB varies in a cyclical waveform with a maximum amplitude S2 and a fluctuation cycle of T2. In the second example, the mean rotating speed during one cycle of the coating brush TB is different from the standard speed when the rotating speed of the coating brush TB varies. The fluctuation cycle T2 is 720 degrees in terms of the rotating angle of the photographic sensitive drum 41Y.

In the second example, the maximum amplitude S2 is 0.9 rpm on the upper limit speed side, and the maximum rotating speed of the coating brush TB is 382.5 rpm. In other words, the rotating speed of the coating brush TB reaches at least the upper limit speed among the upper limit speed and the lower limit speed while it is fluctuating. Consequently, the rotating speed of the coating brush TB varies with the maximum amplitude S2 which is larger than the amplitude S1 of the first example, and varies across the standard speed between said upper limit speed and said lower limit speed. Thus, the positional relation of the contact between the brush textile 464 of the coating brush TB and the surface of the photographic sensitive drum 41Y varies for a wider range compared to the case of the first example. As a result, the unevenness of coating of the lubricant on the photographic sensitive drum 41Y is further improved. Moreover, in the second example, the rotating speed of the coating brush TB can be configured in such a way as to reach at least the lower limit speed among the upper limit speed and the lower limit speed while it is fluctuating.

Figure 9:
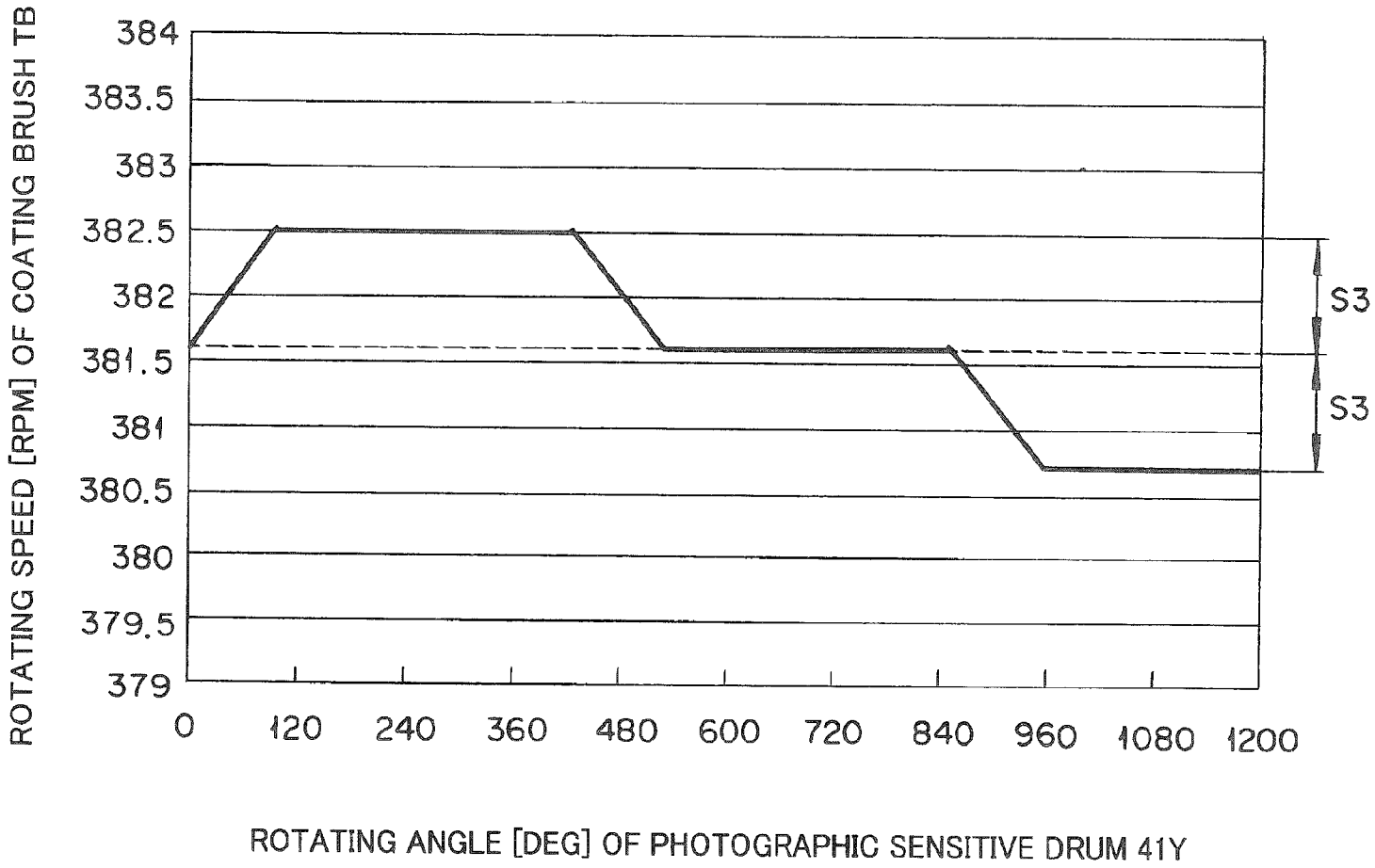
FIG. 9 is a diagram showing a third example related to the fluctuation of the rotating speed of the coating brush relative to the rotating angle of the photographic sensitive drum.

FIG. 9 is a diagram showing a third example related to the fluctuation of the rotating speed of the coating brush TB relative to the rotating angle of the photographic sensitive drum 41Y.

The rotating speed of the coating brush TB varies with the maximum amplitude S3. The premise of the third example is that the fluctuation of the rotating speed of the coating brush TB is not cyclical. However, the fluctuation of the rotating speed of the coating brush TB can be cyclical as in the first and second examples.

In the third example, the maximum amplitude S3 is 0.9 rpm, while the maximum rotating speed of the coating brush TB is 382.5 rpm and the minimum value is 380.7 rpm. In other words, the rotating speed of the coating brush TB reaches both the upper limit speed and the lower limit speed while it is fluctuating. Consequently, the rotating speed of the coating brush TB varies with the maximum amplitude S3 which is larger than the amplitude S1 of the first example, assumes the maximum amplitude S3 in the ranges both above and below the standard speed, and varies across the standard speed between said upper limit speed and said lower limit speed. Therefore, the positional relation of the contact between the brush textile 464 of the coating brush TB and the surface of the photographic sensitive drum 41Y varies for a wider range compared to the first and second examples. As a result, the unevenness of coating of the lubricant on the photographic sensitive drum 41Y is further improved.

In the third example, the rotating speed of the coating brush TB is held at a predetermined speed for a predetermined time period while it is fluctuating. For example, the predetermined speeds are 380.7 rpm, 381.5 rpm, and 382.5 rpm, while the predetermined time period is the time period that corresponds to 324.0 degrees in terms of the rotating angle of the photographic sensitive drum 41Y. As such, since the rotating speed of the coating brush TB is held at a predetermined speed for a predetermined time period during its fluctuation, a stable control of the rotating speed of the coating brush TB can be achieved by the CPU 101. In other words, control errors such as gear backlash in the driving unit 70 that are caused by the fluctuation of the rotating speed of the coating brush TB can be reduced. Consequently, the coating of the lubricant on the photographic sensitive drum 41Y can be done in a stable manner, so that the unevenness of coating caused by the control errors of the driving unit 70 can be restrained as well. Moreover, various values can be applied as the predetermined speed and the predetermined time period without being limited to the values mentioned above.

As can be seen from the above, since the rotating speed of the coating brush fluctuates between the upper limit speed and the lower limit speed across the standard speed obtained by multiplying the rotating speed of the rotating member by a predetermined natural number, it is possible to provide an image forming apparatus capable of improving the unevenness of coating on the rotating member.

The specific configuration of the present invention is not limited to the present embodiment, but rather those with modifications and additions within the gist of the present invention shall be included in the present invention. For example, in order to improve the unevenness of coating, it is preferable for the rotating speed of the coating brush TB to reach both the upper limit speed and the lower limit speed while it is fluctuating as shown in the third example. In order to accomplish that, the amplitude S1 in the first example is preferably 0.9 rpm.

Although the rotating speed of the photographic sensitive drum 41Y and the natural number are assumed to be 95.4 rpm and 4 in the present embodiment, the invention is not limited to them.

The fluctuation of the rotating speed of the coating brush TB is not limited to those indicated in the first through third examples but rather it can assume any kind of waveform. For example, the rotating speed of the coating brush TB can vary with various kinds of cyclic waveforms other than the sinusoidal waveform such as saw tooth, trapezoidal, and triangular waveforms. Furthermore, the fluctuation of the rotating speed of the coating brush TB does not necessarily have to be cyclical. However, the fluctuation of the rotating speed of the coating brush TB is preferably cyclical for the sake of simplifying the preparation of the coating brush fluctuation program.

Although the photographic sensitive drum 41Y is assumed as the rotating member in the present embodiment, the rotating member is not limited to it. For example, it is possible to use the second nip roller 48 in the second transfer position and the belt and roller at the fixing unit 50 as the rotating member.

In the present embodiment, the driving unit 70 is controlled based on the coating brush fluctuation program stored in advance in the storage device such as the ROM 102 or the hard disk 104. Consequently, the burden of the controller can be reduced as it is not necessary to compare between the detection result of the sensor and a specific standard in fluctuating the rotating speed of the coating brush TB.

The means and method of conducting various processes based on the coating brush fluctuation program according to the present embodiment can be realized either by a dedicated hardware circuit, or by a programmed computer. The above coating brush fluctuation program can be provided either by a computer readable recording medium such as a flexible disk or CD-ROM, or on-line via a network such as the Internet. In such a case, the coating brush fluctuation program recorded on the computer readable recording medium is normally transferred to and stored on a storage device such as a hard disk. Also, the coating brush fluctuation program can be either provided as a standalone application software or can be built into the software of a printing system as one of its function.

What is claimed is:

1. An image forming apparatus comprising:

a rotating member supported rotatably;

a rotatable coating brush that is wound spirally on a metal core in order to coat said rotating member with a lubricant;

a supply unit for supplying the lubricant on said coating brush;

a drive unit for driving said coating brush; and a controller for controlling said driving unit in such a way as to cause a rotating speed of said coating brush to fluctuate between an upper limit speed and a lower limit speed across a standard speed obtained by multiplying a rotating speed of said rotating member with a predetermined natural number;

wherein said controller controls said driving unit in such a way as to cause a fluctuation cycle of the rotating speed of said coating brush and a cycle of said rotating member to be different in case when a mean rotating speed within one cycle of said coating brush matches with said standard speed while the rotating speed of said coating brush fluctuates.

2. The image forming apparatus claimed in claim 1, wherein the rotating speed of said coating brush is between the upper limit speed and the lower limit speed while the rotating speed of said coating brush is fluctuating.

3. The image forming apparatus claimed in claim 1, wherein the rotating speed of said coating brush is held at a predetermined speed for a predetermined time period while the rotating speed of said coating brush is fluctuating.

* * * * *